United States Patent [19]

Graef et al.

[11] 4,113,140

[45] Sep. 12, 1978

[54] SEALED TAMPER-INDICATING MONEY DISPENSING CONTAINERS FOR AUTOMATIC BANKING SYSTEMS

[75] Inventors: Harry T. Graef, Dover; Jack M. Richardson, Canton; Robert P. Wolfarth, North Canton, all of Ohio

[73] Assignee: Diebold Incorporated, Canton, Ohio

[21] Appl. No.: 761,288

[22] Filed: Jan. 21, 1977

[51] Int. Cl.[2] ..... B65H 1/02

[52] U.S. Cl. ..... 221/6; 221/210; 221/227

[58] Field of Search ..... 221/210, 9, 6, 226, 221/227, 198; 194/4 R, 10, 4 B, 2; 220/210

[56] References Cited

U.S. PATENT DOCUMENTS

| | | | |
|---|---|---|---|
| 3,372,785 | 3/1968 | Bei et al. | 194/10 |
| 3,877,559 | 4/1975 | Burgin | 194/4 G |

*Primary Examiner*—Stanley H. Tollberg
*Attorney, Agent, or Firm*—Frease & Bishop

[57] ABSTRACT

Banking equipment money dispensers wherein a bill picker removes paper money bills one at a time from stacked bills at a dispenser station. The stack of bills is delivered with maximum security in a sealed, loaded container from a central bank loading station. Bills are dispensed at the dispenser station through an access opening by a bill picker. The locked container delivered to the dispenser station is mounted on and locked to a retainer. Unlocking the container access and entry opening closure lock permits loading with a stack of bills and dispensing bills from the stack. The closure lock has duplicate keys for locking and unlocking the lock, one maintained protectively at the bank loading station and the other held captive by the dispenser retainer. The captive key can unlock the container lock only when the container is in retained position. The locked container during delivery cannot be opened without physical damage. Container tampering at any time when locked and not at the loading or dispenser stations is shown by physical damage appearance. When the container money supply is depleted the container is locked and removed from the dispenser station and replaced by a filled container. Money supply depletion is signaled. The sealed tamper indicating container delivery system provides for delivering a supply of paper money to an automatic banking unit money dispenser under conditions of maximum security.

30 Claims, 29 Drawing Figures

FIG.15
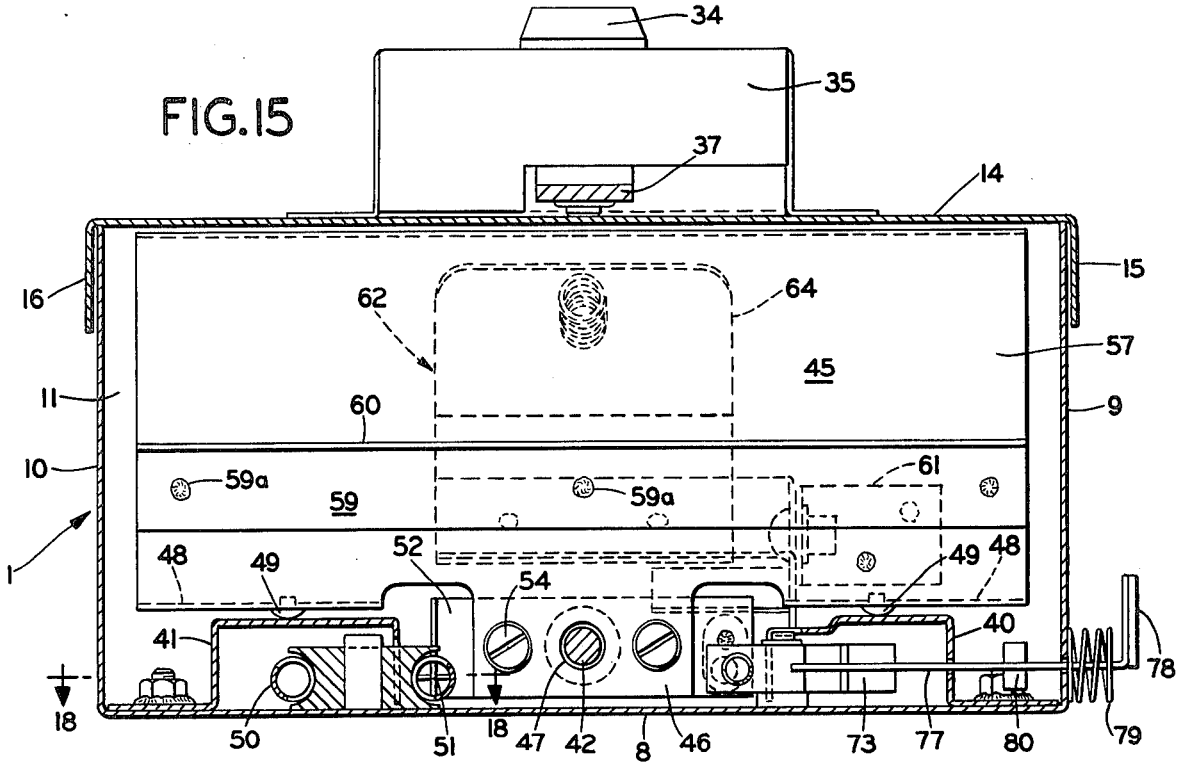
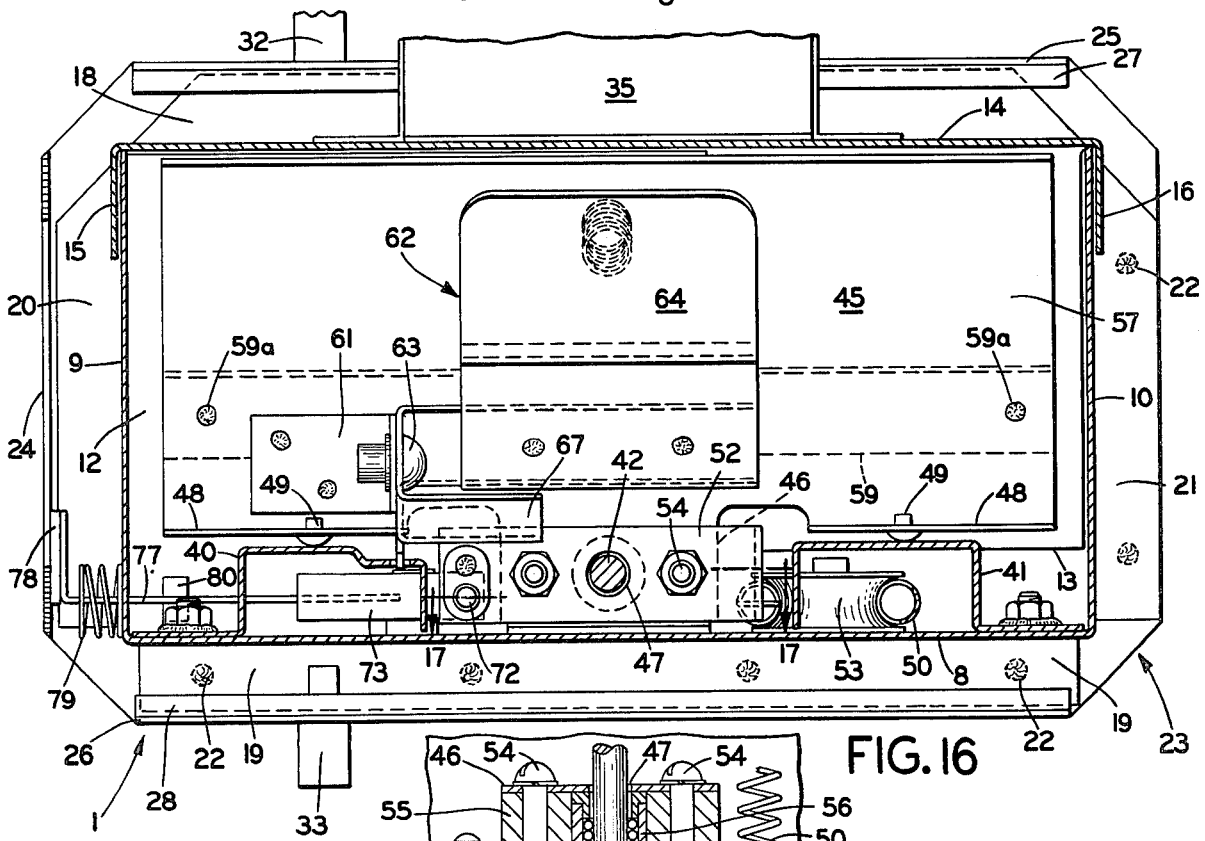
FIG.16
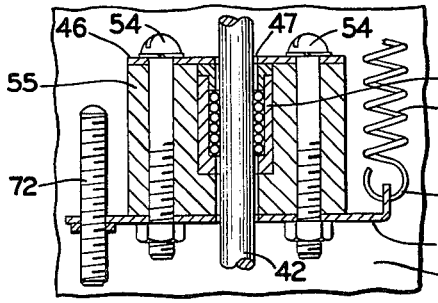
FIG.17

SEALED TAMPER-INDICATING MONEY DISPENSING CONTAINERS FOR AUTOMATIC BANKING SYSTEMS

BACKGROUND OF THE INVENTION

1. Field of the Invention

The invention relates to a system for handling, and delivering and supplying to a remote banking unit a large charge or supply of paper money in a sealed container, which charge or supply is packed or loaded, and locked or sealed, in the container at a central bank; and which container is delivered in locked condition to the remote banking unit by an accountable messenger where the container is mounted in retainer means of the remote cash dispensing system banking unit, and where the container may be unlocked only while held in retained position in the unit.

More particularly, the invention relates to a locked container charged while unlocked at a bank with a paper money supply for an automatic banking system remotely located money dispenser, which locked container cannot be opened without physical damage, that discloses any occurrence of tampering with the container at any time when not located at the bank where loading occurs or while retained at the remote unit; and in connection with which money shortage in the container at any time discloses unauthorized entry.

Further, the invention relates to a handling system and container for paper money bills in which depletion of the paper money content of the container to a predetermined minimum number of bills is signaled by such depletion.

Finally, the invention relates to a sealed tamper-indicating container adapted to be used in the manner described in coordination with components of an automatic banking system remotely located money dispenser, to provide a new system of handling, delivering and supplying a charge of paper money to the remote banking unit under conditions of maximum security.

2. Description of the Prior Art

Automatic banking units for dispensing paper money at remote locations must contain a supply of paper money for delivery to a bank customer to carry out a requested and authorized money dispensing operation. Heretofore, the paper money supply has been loaded as loose money directly at the remote unit into a money supply compartment from which it is picked and conveyed to an opening in the unit accessible to the customer. The supply of paper money used to load the remote unit compartments ordinarily has been in the possession of authorized bank personnel who make service calls on a number of remote automatic banking units at intervals frequently enough to avoid exhausted money supplies at any units. These service calls also involve inspection, adjustment, etc. of the units as well as replenishing the money supply in all units requiring additional money.

The handling, delivering and supplying of loose money by authorized and trusted bank personnel in this manner is vulnerable to attack at any time during transportation of the money from the bank to the various remote units, and during loading of loose money into money-receiving pockets of any of the remote units.

Also, careful and complicated accounting procedures must be established and followed to record the disposition of currency to each and all units serviced by the bank service personnel as well as the accounting necessary concerning currency charged to and distributed to remote units by personnel performing the servicing operation, to determine the existence or amounts of accidental or surreptitious shortages.

These matters which characterize the present systems of servicing remote automatic banking units, and of maintaining the necessary supply of paper money in all units, may involve serious security problems at any time.

There are no provisions in the prior art, of which we are aware, for maximum security in the handling, delivery and supplying of paper money to remote unattended automatic banking units under locked or sealed and readily accountable conditions. There thus exists a need in the field of dispensing paper money at remote automatic banking system units for a system and equipment for delivering paper money in sealed tamper-indicating money dispensing containers, by accountable messengers, who have no direct access to the paper money, per se, and who may be armed accountable guards of armored banking media transportation and delivery service systems.

SUMMARY OF THE INVENTION

Objectives of the invention include providing a system for supplying paper money to automatic banking system remote unit money dispensers in which the money supply is contained in a locked container at all times except when the container is located at a bank for being charged with paper money or is located at a remote unit coupled with other components for dispensing the container contents; in which accountable personnel charged with transporting such containers between a bank and a remote unit at no time have direct access to the container contents; in which such containers and remote units are equipped with non-duplicable lock-key components, and all containers assigned to any particular remote unit having the same lock, and having only two keys for such lock, a captive key at the particular remote unit and a bank key held protected at the bank, and with different lock-key components for each different remote unit, providing such lock-key components, container construction, and remote unit container retainer means which when the container and retainer means are held coupled may have the container unlocked for access to its paper money content, which container may be uncoupled from its remote unit retainer means only when locked to prevent access to the container contents; providing such container construction which when locked visibly indicates any attempt to gain unauthorized access to its contents or any attempt to tamper with the container; providing such new system and container construction which when locked maintains in a secure state and indicates attempts to gain access to banking media container content during transportation from a bank to supply money to cash dispensers of banking equipment or remote units of automatic banking systems; providing such systems and containers which enable accountable personnel to handle and transport such containers loaded with large amounts of paper money; providing a new paper money container construction with door means, container retainer means, container lock-key means, paper money compressor means, money depletion indicator means and coordinated and interlocking means therefor; and providing such new system and container construction which achieve the stated objectives in a most efficient and highly secure manner, and eliminate difficulties, solve problems and satisfy needs existing in the automatic banking equipment field.

These and other objects and advantages may be obtained by the new system and container for supplying and delivering paper money to banking system money dispensing mechanism, preferably remote units of automatic banking system equipment, the general nature of which may be stated as including paper money container means forming a compartment for receiving a supply stack of paper money; the container having a wall formed with an access opening through which paper money may be picked from the paper money supply stack; door means for the opening movable between open and closed positions; lock means for the door means for locking the door means in closed position when locked and when unlocked releasing the door means for movement between open and closed positions; retainer means for the container means to which the container means may be coupled when its door means is locked, and which holds the container means coupled when the lock means is unlocked; key means for the lock means consisting of a captive key and a bank key; the lock means and key means comprising non-duplicable lock-key components; the captive key being held captive by the retainer means in position to actuate the lock means when the container means is coupled with the retainer means in position to be maintained coupled; said captive key being engageable with the container lock means of coupled container means to unlock said lock means; said captive key being locked to said lock means when the lock means is unlocked; the bank key being engageable with the lock means when the container means is uncoupled from said retainer means; the door means when unlocked by said bank key, being completely removable from the container means; lid means releasably closing the container means; the lid means being held in closed position on the container means by said door means when the door means is locked to said container means by said lock means; said lid means being removable from the container means when the door means is completely removed from the container means; the paper money receiving compartment being exposed for access to its contents and refilling of said compartment with a paper money supply stack when the lid means is removed; adjustable compressor means slidably mounted in the compartment and engageable with paper money supply stack to press the supply stack toward the access opening; means biasing the compressor means toward the paper money supply stack in the compartment; the compressor means including adjustable ratchet means releasably inter-engageable between the compressor means and container means at spaced intervals for maintaining the compressor means in compressing engagement with the paper money supply stack; the compressor means including latch means engageable with the container means to hold the compressor means in non-compressing position to permit charging of the compartment with a supply stack of paper money; plunger means mounted in the container for biased movement from restrained position toward signaling position when released; means for holding the plunger means in restrained position including adjustable trigger means mounted on the compressor means engageable with the restraining means to release the plunger means when the paper money supply stack has been depleted to a predetermined number of paper money bills; depletion signal means including a switch mounted on the retainer means actuated by the plunger means when the plunger means is released from a container coupled with the retainer means; and the plunger means and plunger holding means having interengageable cam means for resetting the plunger means in restrained position when the door means is assembled to locked position on the container means after refilling the compartment with a paper money supply stack.

BRIEF DESCRIPTION OF THE DRAWINGS

A preferred embodiment of the invention — illustrative of the best mode in which applicants have contemplated applying the principles — is set forth in the following description and shown in the drawings and is particularly and distinctly pointed out and set forth in the appended claims.

FIG. 15 is a cross-sectional view of the container looking in the direction of the arrows 15—15, FIG. 8;

FIG. 16 is a cross-sectional view similar to FIG. 15 but looking in the direction of the arrows 16—16, FIG. 8;

FIG. 17 is a fragmentary sectional view looking in the direction of the arrows 17—17, FIG. 16;

Similar numerals refer to similar parts throughout the drawings.

DESCRIPTION OF THE PREFERRED EMBODIMENT

Figure 1:
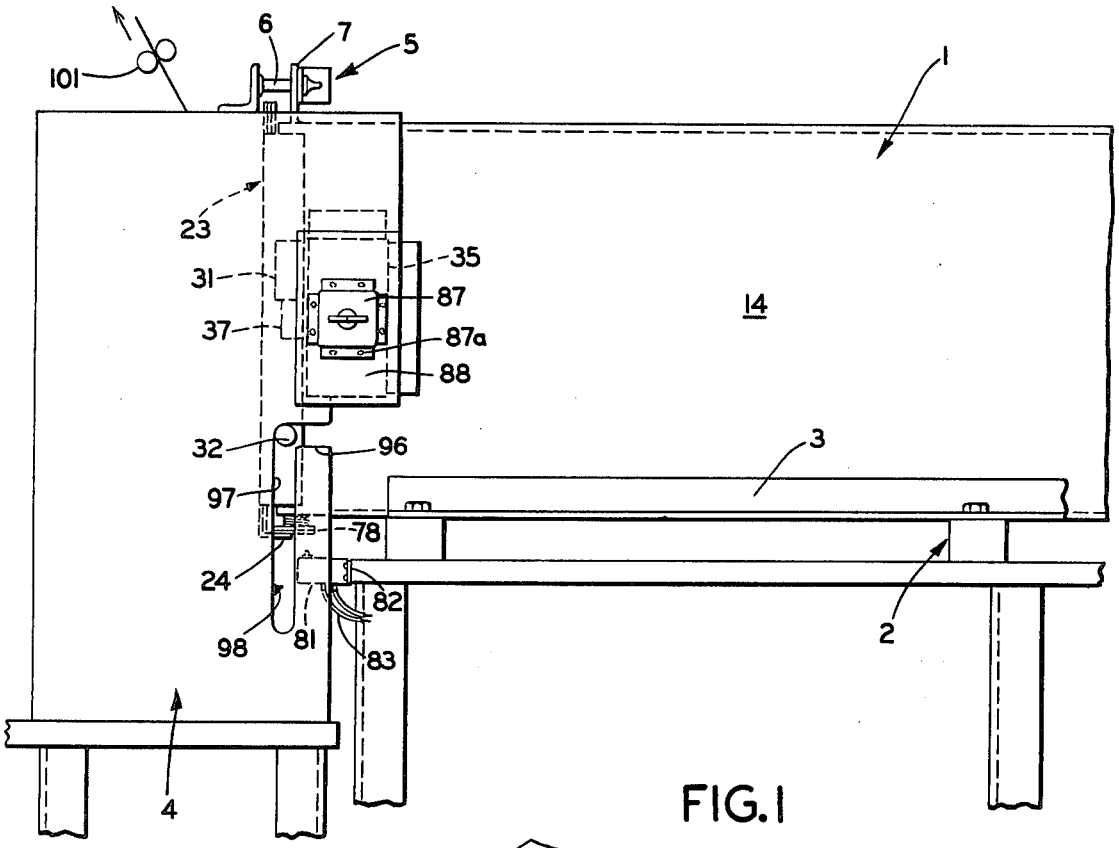
FIG. 1 is a somewhat diagrammatic side view illustrating the improved container in locked condition installed in a remote banking unit in position to be retained in remote unit retainer means.

A sealed tamper-indicating money dispensing container is generally indicated at 1 in the drawings and holds a supply of paper money for operation of a typical remote automatic banking unit, such as shown in U.S. Pat. No. 3,880,320. A transaction of dispensing currency to a bank customer who has presented a coded card to such a remote unit, which card is verified to indicate that the user is an authorized user, involves entering into the unit necessary information concerning the transaction, followed in prior devices by operation of picker and transportation means, such as shown in U.S. Pat. No. 3,760,158, as stated in U.S. Pat. No. 3,880,320 to deliver to the customer the paper money being dispensed from a supply thereof in the remote unit.

Heretofore, the supply of paper money in the cash dispensing component of U.S. Pat. Nos. 3,760,158 and 3,880,320 is replenished when depleted by inserting loose currency directly into the currency receptacle in the remote unit after opening a protected compartment in which the currency receptacle is housed in the remote unit.

The improved sealed currency container 1, which comprises an aspect of the present invention is mounted in sealed condition in a protected compartment in the housing of the remote banking unit. Support means 2 for the container, having guide brackets 3, illustrated diagrammatically in the drawings, is located within the protected compartment of a remote automatic banking unit preferably of a type shown in U.S. Pat. No. 3,880,320. A picker mechanism housing 4 also is located in the protected compartment adjacent the support means 2. Picker housing 4 may contain any desired form of picker means, such as shown, for example, in U.S. Pat. No. 3,760,158.

In accordance with the invention, the sealed currency container 1 is placed on the support means 2 within the protected compartment after opening the compartment. Container 1 is moved to the position shown in FIG. 1, where it can be retained in fixed position with respect to the picker mechanism 4 by retainer means described below.

Aligning fastener means, generally indicated at 5 which may include a pin 6 carried by the picker mechanism 4 and a bracket fastener 7 carried by the container 1, in addition to the guide brackets 3, provide means for guiding the container 1 to and for locating it at a position to be held retained (FIGS. 1 and 2), as a step in placing a container 1 filled with a supply of paper money in an operative position with respect to the picker mechanism 4 within the protected compartment of a remote banking unit.

In accordance with the invention, the container 1 is loaded with paper money at a central bank and is then transported to its remote unit, preferably by armed accountable guards that travel in armored banking media transportation cars, which generally provide protected delivery services for banking media.

The container 1 is completely sealed and locked at all times except when at the bank for being loaded with currency or when installed and held by retainer means in a fixed retained position at the remote unit. When an empty container 1 at a remote unit is removed and replaced by a loaded container, it likewise is sealed and locked as a step in removal and only can be opened at the bank upon return to the bank for loading.

At no time does any handling or delivery personnel have direct access to the contents of the container, whether loaded or empty.

CONTAINER STRUCTURE

The container 1 (FIGS. 6 to 9 and 15–16) has a five-sided base or receptacle comprising a base wall 8, two side walls 9 and and 10, a rear end wall 11, and a door end wall 12. The door end wall 12 is formed with a rectangular opening 13 which provides access to the paper money supply in the container 1.

The sixth or top wall of the container 1 is formed by a lid 14. The lid 14 has downturned flanges 15, 16 and 17 which telescope over the upper ends of side walls 9 and 10 and rear end wall 11, respectively. The door end of the lid 14 is formed with an upturned flange 18. The door ends of the base wall 8, the side walls 9 and 10 each are formed with outturned flanges 19, 20 and 21, respectively.

Figure 7:
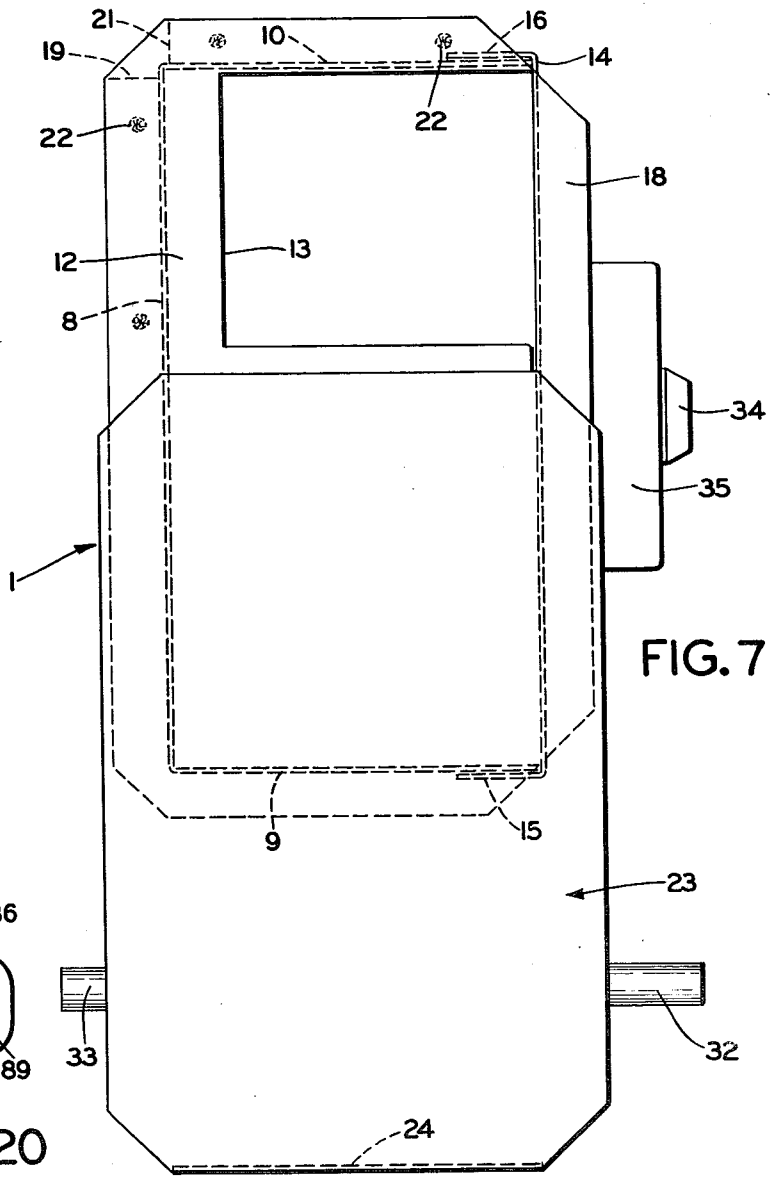
FIG. 7 is a view similar to FIG. 6 of the parts as shown in FIG. 5 with the door open.

The door end wall 12 is secured to the outturned flanges 19, 20 and 21 by any usual means as by spot welding, such as indicated at 22 in FIG. 7. The door end wall 12 lies in the same plane as that of the upturned lid flange 18 so that the outer surfaces of the door end wall 12 and lid flange 18 provide a flush surface along which the door, generally indicated at 23, may be slidably mounted.

Figure 3:
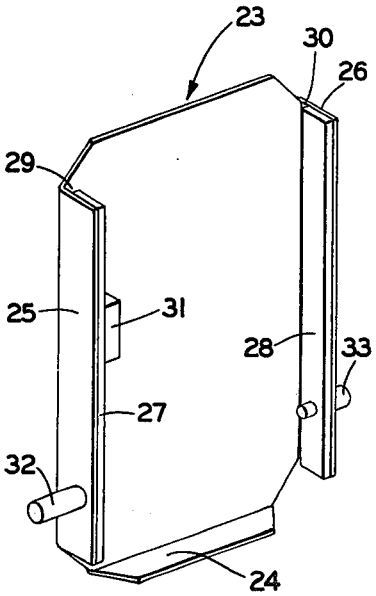
FIG. 3 is a perspective view of the inside of the container door removed from the container.

The door 23 (FIG. 3) has a stop flange 24 and two opposite slide flanges 25 and 26. Retainer strips 27 and 28 are spot welded to the inner face of slide flanges 25 and 26, respectively. The inner edges of retainer strips 27 and 28 are spaced at 29 and 30 from the inner surface of the main panel portion of the door 23 from which the flanges 24, 25 and 26 project, for a purpose to be described.

A lock stop block 31 is mounted on the retainer strip 27 extending inward toward retainer strip 28. Two pins 32 and 33 are mounted on and project laterally outward from the door slide flanges 25 and 26, respectively, spaced a short distance above the door stop flange 24.

Figure 10:
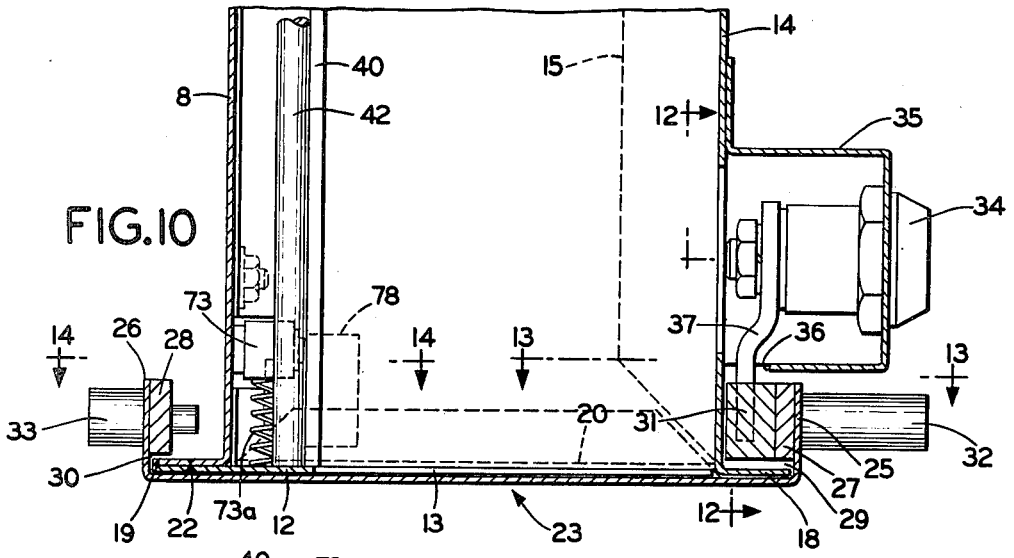
FIG. 10 is an enlarged fragmentary sectional view taken on the line 10—10, FIG. 6, showing the door lock locked.
Figure 11:
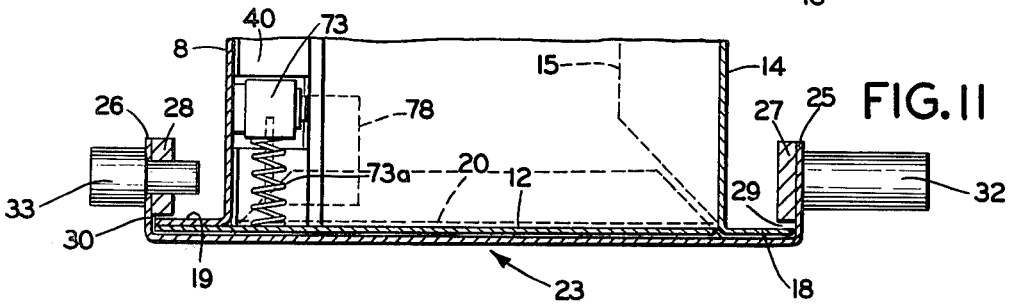
FIG. 11 is a sectional view similar to FIG. 10 taken on the line 11—11, FIG. 6.
Figure 13:
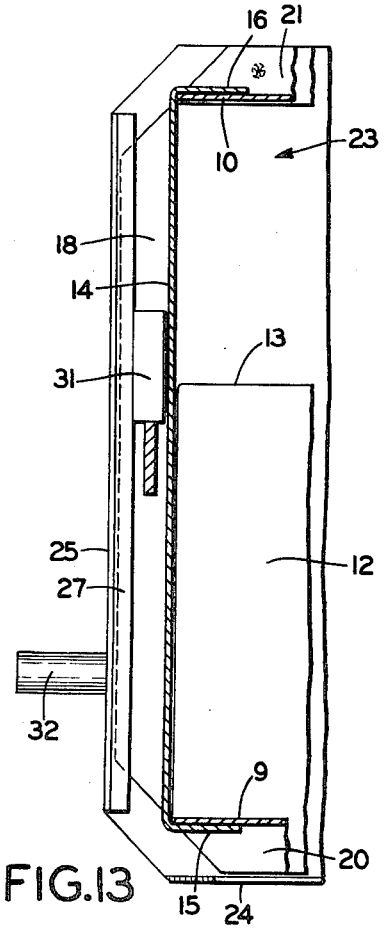
FIG. 13 is a fragmentary sectional view looking in the direction of the arrows 13—13, FIG. 10.
Figure 14:
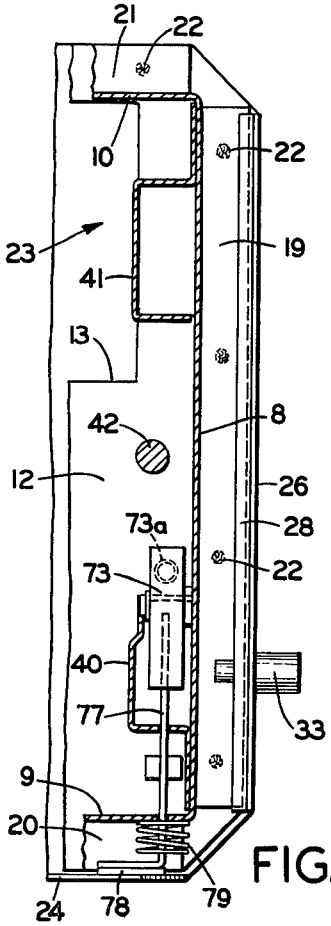
FIG. 14 is a fragmentary sectional view looking in the direction of the arrows 14—14, FIG. 10.

The door 23 is slidably mounted on the door end of the container 1 with the lid flange 18 projecting into space 29 along the door flange 25 between the door 23 and retainer strip 27, and with the base wall flange 19 projecting into the space 30 between the door 23 and the retainer strip 28 (FIGS. 10 and 11). The grooves formed by the spaces 29 and 30, cooperating with the flanges 18 and 19 which project into the grooves, form a sliding tongue and groove mount for the door 23 on the container 1.

Figure 5:
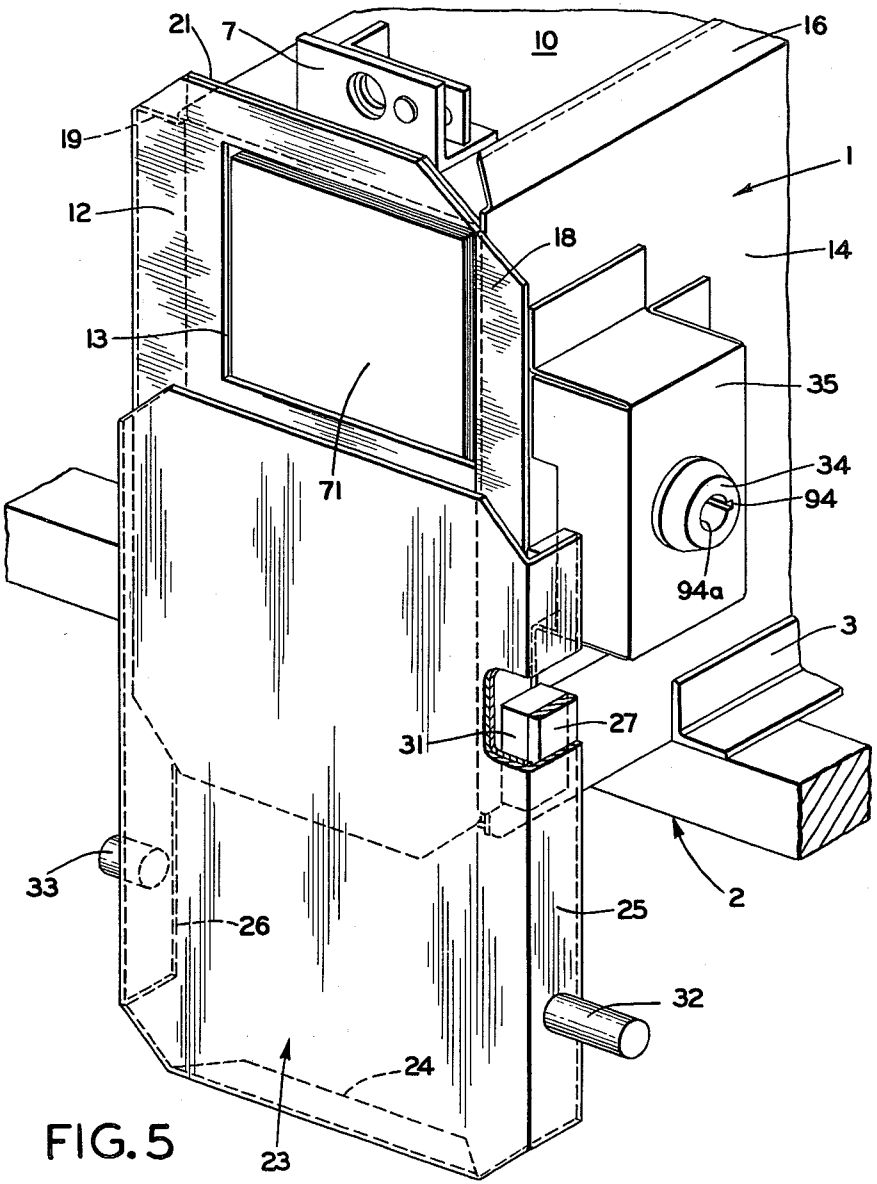
FIG. 5 is a view similar to FIG. 4, with parts broken away and in section, showing the container unlocked and the door moved to open position.
Figure 4:
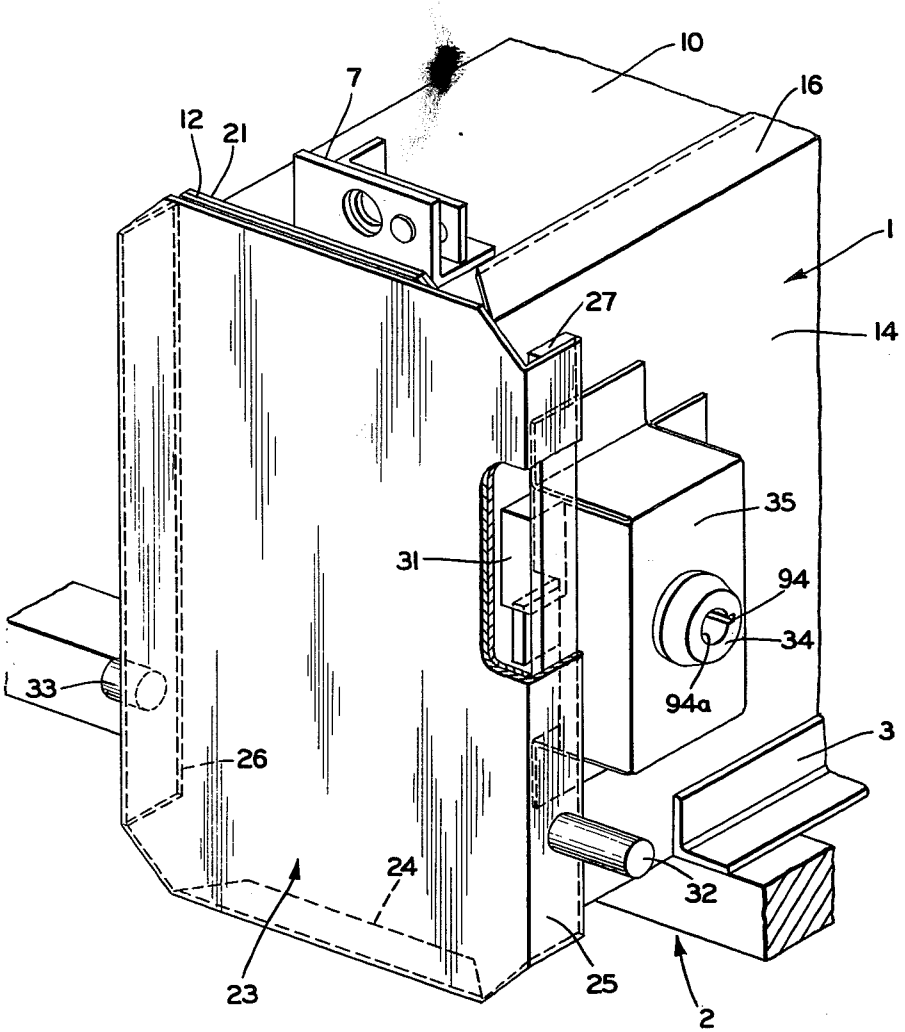
FIG. 4 is an enlarged somewhat diagrammatic perspective view, with parts broken away, of the door end of the container shown in FIG. 1, with the retainer means removed, and the container locked.
Figure 6:
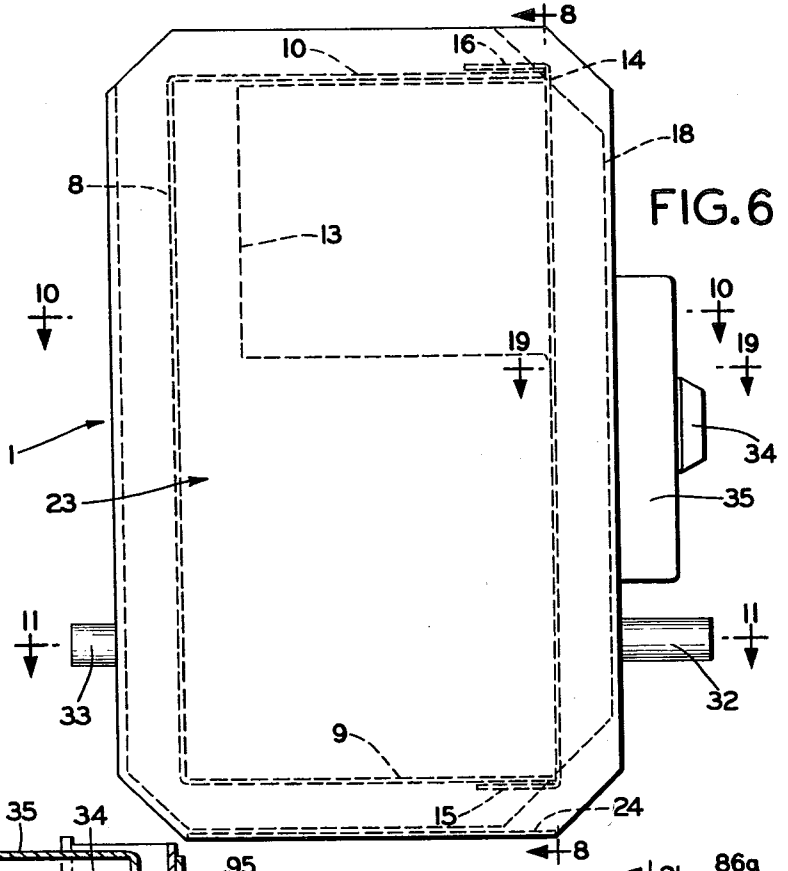
FIG. 6 is an outside view of the door end of the container with the door closed.

The door 23 is shown in closed position in FIGS. 4 and 6 and in open position in FIGS. 5 and 7. A lock 34 is mounted in a housing 35 on the lid 14. Housing 35 is formed with a bolt opening 36 through which the lock bolt 37 projects in locked position of the lock bolt, in which position lock bolt 37 engages below the lock stop block 31 on the door 23 to hold the door locked in closed position when the lock is locked (FIGS. 4, 10 and 12).

Figure 12:
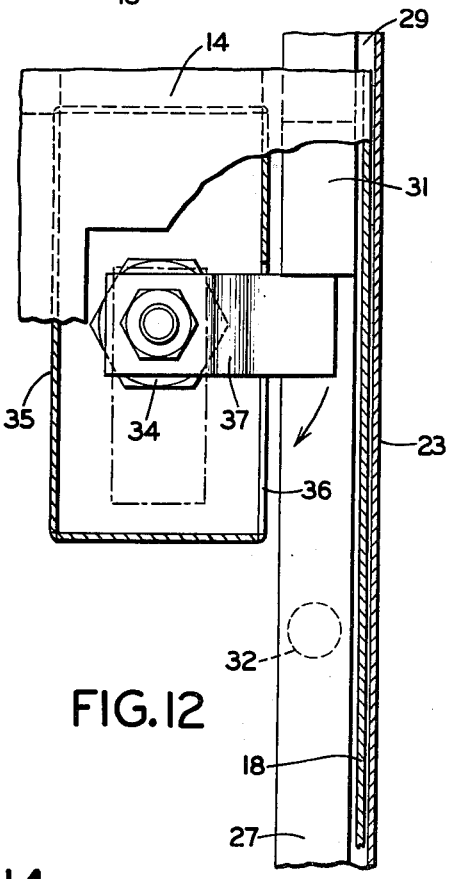
FIG. 12 is an enlarged fragmentary sectional view looking in the direction of the arrows 12—12, FIG. 10, showing the door lock.

When the lock 34 is unlocked, the bolt is in the position shown in dot-dash lines in FIG. 12, disengaged from the stop block. This permits the door 23 to slide on the tongue and groove mount from locked to unlocked door position and vice versa.

The door 23 may be moved from locked or closed position to unlocked or open position or vice versa by grasping one or both of the pins 32 and 33 in a manner described below. As stated, when the door 23 is in open or unlocked position, the access opening 13 in the door end wall 12 is exposed so that paper money may be picked from the container 1 by the picker means of picker mechanism 4.

Figures 8, 18, 21, 22, 23:
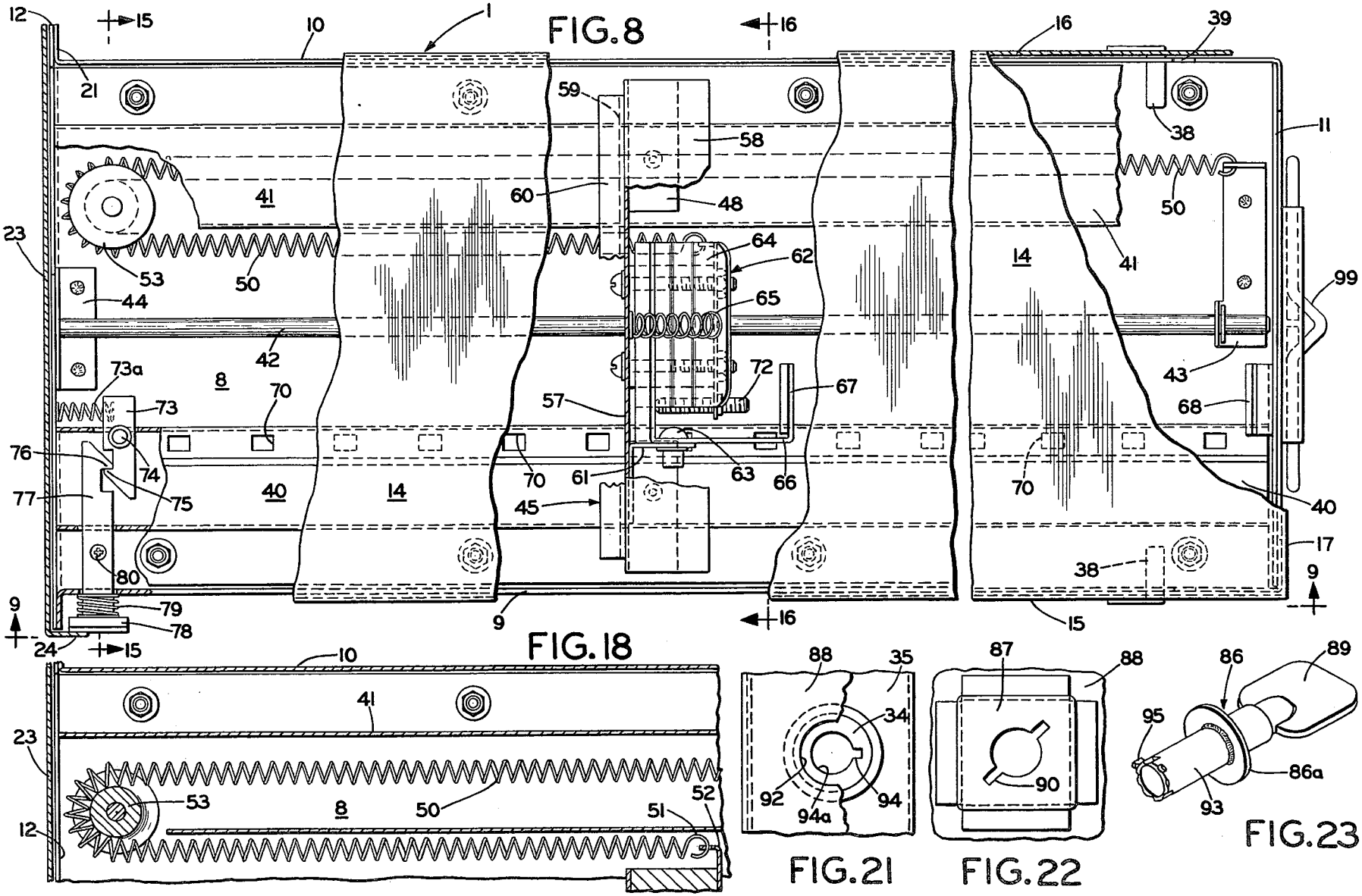
FIG. 8 is a view of the lid side of the container with parts broken away, looking in the direction of the arrows 8—8, FIG. 6 toward the lid.
FIG. 18 is a fragmentary sectional view showing the tensioning device for the money compressor, taken on the line 18—18, FIG. 15.
FIG. 21 is a fragmentary view taken on the line 21—21, FIG. 20 with the key removed.
FIG. 22 is a view similar to FIG. 21 looking in the direction of the arrows 22—22, FIG. 20 with the key removed.
FIG. 23 is a perspective view of a form of key such as illustrated in FIGS. 19 and 20.
Figures 9, 24, 25, 26, 27, 28, 29:
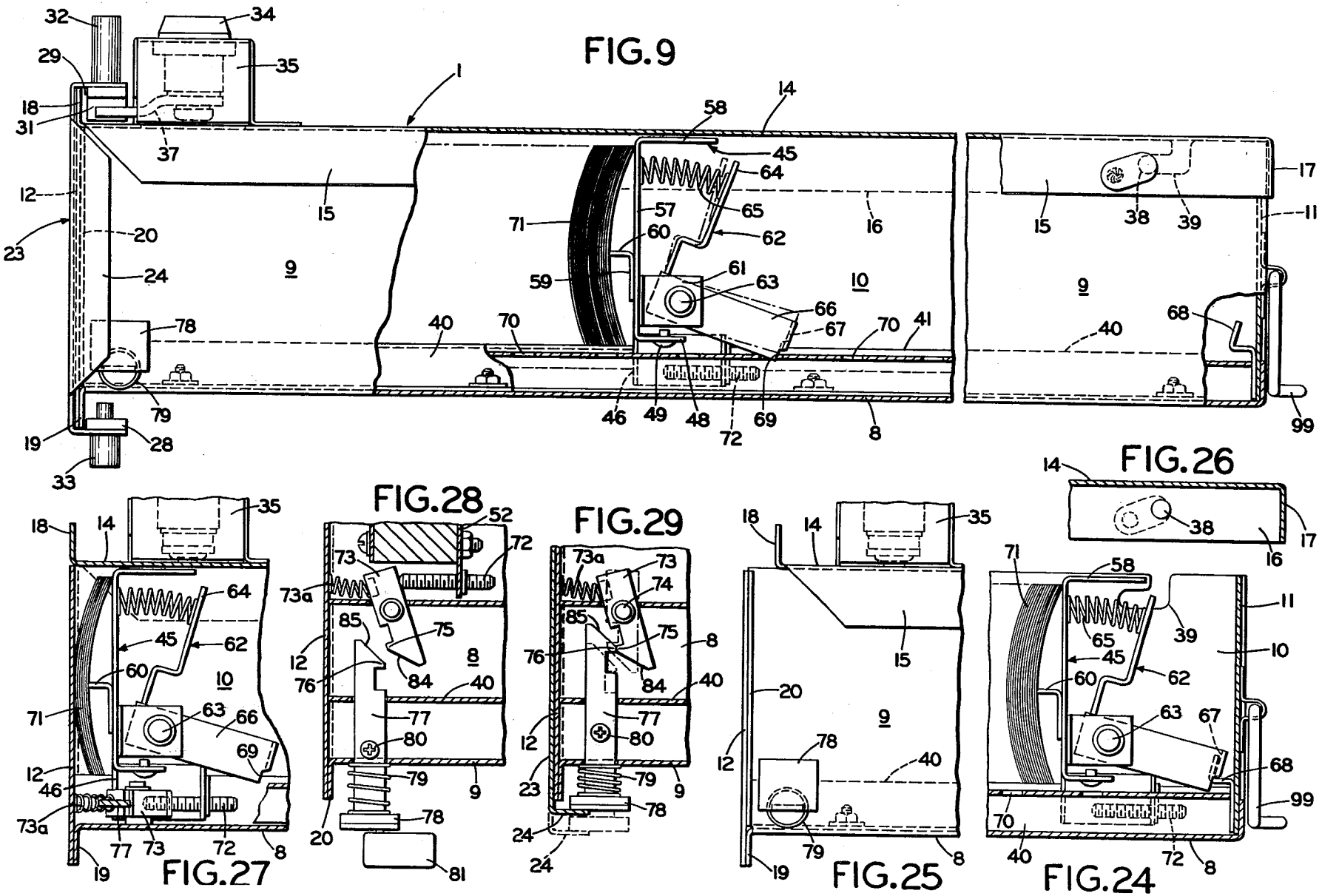
FIG. 9 is a bottom view of the container, with parts broken away and in section, looking in the direction of the arrows 9—9, FIG. 8 toward the lower end of the door, and showing the money compressor.
FIG. 24 is a fragmentary sectional view of the right-hand portion of FIG. 9, with the compressor retracted to and retained at a position for filling the container with paper money, and with the lid removed.
FIG. 25 is a fragmentary view similar to the left-hand portion of FIG. 9 with the door removed and the lid moved to the right to permit separation of the lid from the container base.
FIG. 26 is a fragmentary portion of the right-hand end of the lid showing it disengaged from the container base and lifted from the base shown in FIG. 24.
FIG. 27 is a fragmentary sectional view of the container with the door removed showing the trigger on the money compressor tripping the depletion signal means as a result of depleted money supply.
FIG. 28 is a fragmentary sectional view similar to a portion of the lower left-hand corner of FIG. 8 of some of the parts shown in FIG. 27, and showing the latch for the depletion signal means tripped by the money compressor trigger.
FIG. 29 is a view similar to FIG. 28 but showing the automatic resetting of the depletion signal latch when the door is replaced on the container.

Container 1, when not held at a remote unit in a retained position (FIG. 2), and when unlocked at a bank, may be completely opened by completely slidably moving the door 23 downward from the open position of FIG. 7 to disengage the tongue and groove mount of the door. Under such conditions, the upturned flange 18 on the lid also is disengaged from the door groove 29 which permits the lid 14 to be moved to the right, viewing FIGS. 9, 24 and 25, from the position of FIG. 9 to that of FIG. 25. Bayonet joint pins 38 projecting inward of the lid flanges 15 and 16 thus are disengaged from the L-shaped slots 39 formed in the side walls 9 and 10 at their upper edge areas adjacent the rear end wall 11 (FIGS. 8, 9 and 24). The lid 14 may then be lifted from the container as shown in FIGS. 24 and 26 to completely open the container at a bank.

To summarize, the lid 14 is engaged by the door 23 when the door is part of a completely assembled container; and the lid 14 is locked to the container until the door is entirely removed. Removal of the door permits the lid to be moved to a position where it can be released from the remainder of the container, thus permitting paper money to be loaded into the container 1 at a bank.

The five-sided container base or receptacle has a number of components mounted therein. A pair of spaced hollow rail-like members 40 and 41, generally rectangular in cross section, are mounted on and extend longitudinally of the base wall 8 between the rear end wall 11 and the door end wall 12 (FIGS. 8, 9, 15 and 16). A guide rod 42 extends longitudinally of the container centrally between the two rails 40 and 41, the ends of the guide rod 42 being held by brackets 43 and 44 mounted, respectively, on the rear and door end walls 11 and 12 of the container.

A money compressor, generally indicated at 45, has an ear 46 provided with an opening 47 through which the slide rod 42 extends. Compressor 45 is formed with angled feet 48 provided with slide buttons 49 which slidably engage the tops of rails 40 and 41 (FIGS. 15 and 16).

Compressor 45 normally is biased toward the door end of the container 1 by a tension spring 50, one end of which is connected at 51 with a plate 52 mounted on the compressor ear 46. The spring 50 is trained around a pulley 53 located adjacent the door end wall 12 (FIG. 8) from which the spring 50 extends inside rail 41 to and is engaged with the bracket 43 adjacent the rear end wall 11 of the container (FIGS. 8 and 18). Plate 52 is connected to the compressor ear 46 (FIG. 17) by bolts 54 which clamp a bushing retainer 55 containing a ball bushing 56 which slidably mounts the compressor 45 on the guide rod 42.

The money compressor 45 has a main panel 57 from which the ear 46 projects downwardly and from which the angled feet 48 project rearwardly (FIG. 9) from the bottom edge of panel 57. Rearwardly turned flange 58 extends along the top edge of panel 57. A front bar 59 extends laterally of the main panel 57 approximately midway between the feet 48 and flange 58. The front bar 59 preferably is an angle member, one leg of which is spot welded at 59*a* to panel 57 and the other leg 60 of which projects outwardly from the front face of main panel 57 toward the door end of the container 1 for a purpose to be described.

An angle bracket 61 (FIG. 16) is mounted on the back of one rear corner of the compressor panel 57; and a latch, generally indicated at 62, is pivotally mounted at 63 on angle bracket 61.

The compressor latch 62 which may be manually manipulated has an actuator member 64 extending generally upwardly from the pivot 63 and a spring 65 reacts between member 64 and compressor main panel 57 to bias the latch 62 clockwise viewing FIG. 9. A rearwardly projecting leg 66 of latch member 62 has a rear hook portion 67 which may be engaged with a retainer hook 68 mounted on the rear end wall 11 of the container 1 to hold the compressor 45 at the rear end of the container (FIG. 24) against the pull of the spring 50 when loading the container with paper money.

A notch 69 is formed in the latch leg 66 at its lower rear corner between the latch leg 66 and hook 67. This notch 69 provides a ratchet-like pawl which may be engaged in any one of a series of ratchet openings 70 formed in the rail 40 to prevent movement of the compressor 45 rearwardly of any engaged ratchet opening 70, as indicated in FIG. 9, when compressing a supply of paper money bills or currency 71 toward the door end of the container. Thus, the supply of paper money 71 does not become loose if the container is up-ended in transportation by movement of the compressor 45 toward the rear end of the container from the weight of the paper money.

Compressor 45 also carries another component which cooperates in the manner described below with other components of the container. An adjustable threaded screw 72 is mounted on the plate 52 to trigger the operation of a signal which indicates depletion of paper money 71 charged in the container 1 (FIGS. 8, 9, 17, 27 and 28).

The front edge of the forward leg 60 of front bar 59 presses lengthwise against a central region of paper money charged in the container, to impart concavity to the stack of paper money held by compressor 45, as shown in FIG. 9. This concavity formed in the stack of paper money bills is shown in FIG. 9.

DEPLETION INDICATOR MEANS

The container 1 is equipped to indicate depletion of the number of paper money bills contained in container 1 at a time when there only remains an insufficient number of bills to satisfy a requested banking transaction requiring the maximum number of bills that the automatic banking unit is programmed to dispense at any one time, such for example as ten bills. If more than ten bills are required to carry out a banking transaction requested by a customer, ten bills are dispensed in one operation and then the customer must again proceed to repeat carrying out the steps for one or more additional operations to obtain up to ten bills each successive operation.

A latch lever 73 is pivotally mounted at 74 and spring biased by spring 73*a* clockwise viewing FIGS. 28 and 29 adjacent the base wall 8 and extending into the interior of rail 40. Lever 73 is formed with a hook 75 which normally is engaged with a hook 76 at the inner end of a linearly movable depletion indicator plunger 77 slidably mounted in slots formed in a wall of rail 40 and in container side wall 9 (FIG. 8). The plunger has an angular foot or pad 78 at its outer end outside of the container (FIGS. 2 and 8), and a spring 79 reacts between the foot 78 and container side wall 9 to bias the plunger foot 78 outwardly away from container wall 9. A stop pin 80 prevents ejection of the plunger 77 from the container, and the door stop flange 24 on the door 23, when the door is in closed position on the container, holds the plunger 77 in the retained position shown in FIG. 8 where it is also held by the inter-engaging hooks 75 and 76.

When the money supply 71 has reached the predetermined degree of depletion (FIGS. 27 and 28), with the door 23 in open position, the compressor 45 will have moved to the position of FIGS. 27 and 28, and the forward end of the trigger screw 72 at such time will have engaged latch lever 73, and will have moved the lever against the pressure of spring 73*a* to release the hooked engagement between latch lever 73 and plunger 77, as shown in FIG. 28.

Figure 2:
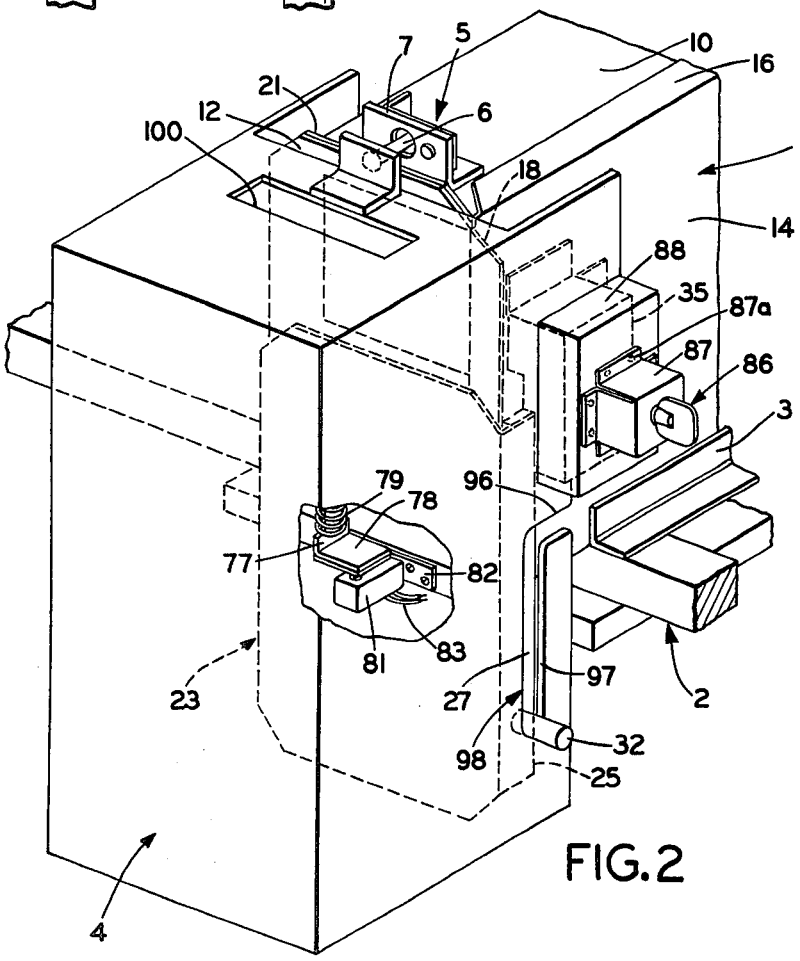
FIG. 2 is a somewhat diagrammatic fragmentary perspective view of the components shown in FIG. 1 with the container held in retained position and unlocked and its unlocked door moved to open position.

This hooked engagement release of hooks 75–76 releases plunger 77 to be ejected outward by spring 79. The ejected plunger pad 78 actuates a switch 81 mounted at 82 within the protected compartment of support means 2 of the banking unit, as shown in FIGS. 1 and 2; the container being in retained position in the automatic banking unit, and the door 23 being in open position. For clarity, the door 23 has been omitted from FIG. 28 which shows the pad 78 actuating switch 81.

The switch 81 may be connected at 83 in the circuitry of the automatic banking unit, so that when the switch is closed, a depletion signal is given in any desired manner visibly or audibly, or both, to a customer who may be using the unit, or is approaching the unit to carry out a banking transaction. Such signal may be accompanied by a legend on the unit indicating that insufficient paper money is in the unit to satisfy a request for a cash dispensing transaction.

After a container 1 has been depleted of paper money, and has been returned to the bank to be charged with a new supply of paper money 71, and has been loaded and is in process of being closed and locked after the lid 14 thereof has been replaced and moved to the position of FIG. 9; the door 23 is assembled on the container and moved to closed position. As the door closing is completed, as shown in FIG. 29, the door stop flange 24 is moved from the dot-dash position to the full line position of FIG. 29, and the flange 24 engages and moves the plunger foot 78 to the retracted position shown. During this plunger motion, the angular cam surfaces 84 and 85 of the ends of the latch lever 73 and plunger 77 slide along one another and reset the plunger release mechanism latch lever 73 to the latched position of FIG. 8.

Container Lock-Key Mechanism

The new system of delivering and supplying paper money to and for automatic banking units under conditions of maximum security involves the use of a lock 34 for the container 1 which has two keys, and only two keys, which may be used to lock or unlock the lock 34 of any particular container. One of such two keys, the "captive key," is generally indicated at 86 in FIG. 23. The other of the two keys, the "bank key," is the same as key 86 but omits the washer 86*a* which is fixed to the barrel of the key 86.

The bank key is held, maintained or stored at the main bank under security conditions available only to bank personnel authorized to unlock or lock containers which are being filled, or refilled or charged with a supply of paper money bills 71. The bank key is used to unlock or lock the lock 34 of the container 1 at the bank. When a locked container, having a depleted supply of paper money bills 71 is returned to the bank, the lock 34 thereof is unlocked by the bank key. This permits the door 23 to be completely removed from the container 1, whereupon the container lid 14 may be moved to the position of FIG. 25 releasing the bayonet joint connection 38–39 between the lid and container body, and then the lid may be completely removed.

Money compressor 45, then by manual manipulation of latch 62, is moved to and latched in the position of FIG. 24 at the rear end of the container. The necessary accounting entries then may be made concerning the amount of paper money comprising the depleted supply thereof that has remained in the container. An entry also is made to identify the particular container being reloaded.

The container then is loaded with a new supply of paper money and accounting entries thereof made. Compressor 45 is released from retained position of FIG. 24 to engage the loaded money. Lid 14 is replaced, door 23 is reassembled on the container 1, and the container lock 34 is locked by the bank key. The loaded container now is ready for delivery to its assigned remote banking unit.

Such assigned banking unit has a twin captive key 86 held in captive position in a key retainer housing 87 mounted on the lock shroud 88 in the protected compartment of the remote banking unit. The lock shroud 88 forms part of the retainer means which ultimately holds the container 1 in retained position in the remote unit, as described below.

The captive key 86 with its retaining washer 86*a* also forms part of the retainer means installation within the protective compartment of the remote banking unit. As stated, key 86 is held captive in the remote unit contained in key retainer housing 87 mounted on the lock shroud 88 which is carried by one wall of the picker mechanism 4, as shown in FIGS. 1, 2, 19 and 20. The lock shroud 88 receives and covers the container lock housing 35 when the container 1 is in retained position of FIGS. 1 and 2.

The captive key 86 initially may be assembled with respect to the key retainer housing 87 by inserting the key thumbpiece 89 from within the housing 87 through slots 90 (FIG. 22). The washer 86*a* on the barrel 93 of key 86 normally is biased against an inside key retainer housing surface by spring 91 which also is assembled within housing 87 before the housing 87 is mounted on lock shroud 88 as by spot welding indicated at 87*a* in FIGS. 1 and 2.

FIG. 22 for clarity illustrates the key retainer housing 87 before being spot welded to the lock shroud 88 and before the key 86 is inserted in retained position in the housing 87. FIG. 21 for clarity also has the key 86 and key retainer housing 87 removed to illustrate the lock shroud 88 and the opening 92 therein through which the barrel 93 of key 86 may be projected to enter the container lock 34. The lock barrel of the lock 34 (FIG. 21) is formed with a groove 94 in the barrel opening 94*a* to receive and index the lug 95 on key barrel 93 when the captive key 86 is inserted into the barrel opening 94*a* of lock 34 in the properly oriented position to unlock a container 1. The key 86 is illustrated in position for such insertion in FIGS. 1 and 19.

Referring to FIG. 1, a loaded container 1 has been delivered to and is being installed in the protective compartment of a remote banking unit from which a similar container 1 having a depleted money supply has been removed. Container 1 is moved from the right (FIG. 1) to the position shown. The aligning fastener means 5 has its pin 6 and bracket fastener 7 engaged, and the pins 32 and 33 on the container have moved through the legs 96 of the L-shaped retainer means slot 98 formed in housing walls of the picker mechanism 4 to the position shown in FIG. 1. This position is termed herein the "retained position," being the position of the container 1 and picker mechanism 4 in which the container 1 is held retained in the protected compartment of the remote unit when the container lock 34 is unlocked and the door 23 moved to open position.

Figure 20:
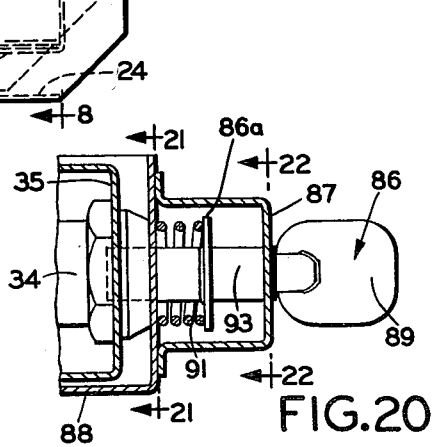
FIG. 20 is a view similar to a portion of FIG. 19, also looking in the direction of the arrows 19—19, FIG. 6, but showing the key inserted in the door lock ready to be rotated to unlock the door lock.
Figure 19:
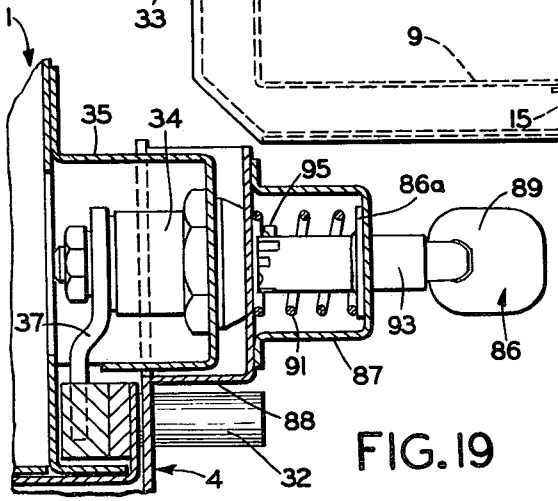
FIG. 19 is a fragmentary sectional view, looking in the direction of the arrows 19—19, FIG. 6, showing the door lock locked and the container in the retained position of FIG. 1, ready to receive the captive key which is in a retracted position.

After the container 1 has been located in retained position as shown in FIG. 1, the key 86 is pushed inward from the position of FIGS. 19 and 1 to the position of FIG. 20 so as to telescope the key barrel 93 within the lock barrel opening 94*a*. The key then may be turned counterclockwise (FIG. 12) from the position of FIGS. 1 and 20 to the position of FIG. 2, unlocking the lock 34 and moving the bolt from the full line position to the dot-dash line position of FIG. 12. Captive key 86 being telescoped in the lock barrel thus hold the container 1 in retained position as unlocking of lock 34 progresses.

After the lock bolt 37 has been moved to unlocked position, the door 23 by grasping pins 32 and 33 may be moved downward (FIGS. 2 and 5) along the vertical leg 97 of the retainer means L-shaped slot 98 in the housing of picker mechanism 4 to the position shown in FIG. 2.

Thus, in unlocking the container 1 and moving the door 23 to the open position, the pins 32 and 33 in addition to the captive key 86 hold the container in retained position, thereby preventing any access to the contents of the container by the delivery service personnel who has delivered the loaded container 1 to the remote unit and assembled the container in held retained position in the remote unit.

Conversely, when a container 1, depleted of paper money, is being removed to be replaced by a charged container, the door 23 first must be moved to closed position, then the key 86 turned to actuate the lock 34 to locked position, thereby locking the door 23 in closed position on the container. Then the captive key 86 is withdrawn or ejected from the lock 34 by spring 91 which permits the container 1 to be released from the picker mechanism in locked condition. The depleted container then may be returned to the bank by the delivery service personnel and meanwhile a loaded container is installed at the remote unit in the manner just described.

Important facets of the new container and system of delivering and supplying paper money to and for automatic banking units under conditions of maximum security revolve around the concept that the container door is closed and locked at the bank after loading, and it can be opened only in retained position at the remote unit or when returned to the bank. When retained at the remote unit and unlocked, as described, the door can be moved to expose the container opening through which money may be picked up by the picker mechanism from the container. However, the container can only be unlocked at the remote unit when in retained position and unlocking the door to permit door movement to open position holds or locks the container in retained position.

The captive key at the remote unit can only be engaged with the container lock when the container is in its retained position, and the captive key is held at all times at and by the remote unit.

The lock 34 and keys therefor are of a type generally known in the lock art as non-duplicable locks and keys, and for example, may be Chicago Lock Company locks and keys such as Lock PL-283. The captive key 86 in addition to being held captive at the remote unit, also cannot be removed from the container lock 34 when the lock is in unlocked position.

In order to provide for installing a loaded container 1 at a remote unit to replace another container at the unit whose supply of paper money has been depleted, in accordance with the concept of the new system, there must be at least two similar containers for any one particular remote unit, both of which containers must have the same lock so that the lock of either container may be actuated by the captive key at the particular remote unit. Thus, the two matching containers may be unlocked by the matching or paired key retained at the bank. All containers for other remote units must have different locks than the locks for serving any particular remote unit. If necessary, more than two containers may be assigned to any one particular remote unit; but as stated, all will have the same lock.

In this manner, the container lock-key mechanism is cooperatively combined with and related to the container construction and the retainer means at any remote unit, to achieve the fundamental objective of the invention, which is to provide for supplying paper money for remote automatic banking units under conditions of maximum security.

Since any container is locked at all times except when installed at a remote unit or when at a bank, visible indication of tampering with the container or unexplained shortage of money contained therein indicates some tampering with or unauthorized access to the money in the container. The handling of containers by delivery service personnel involves personnel that are accountable, such as armored car personnel universally used by banks to transport banking media from place to place under conditions of maximum security.

In this manner, the transfer of containers is possible from one accountable party to another where mutual observance of no indication of unauthorized container entry exists.

In other words, while a locked container is being transported, the supply of money therein cannot be removed without giving an indication of entry.

The procedure for installing a loaded container 1 in a protected compartment of a remote unit, as stated, preferably includes engaging the aligning means 5 to couple the container with the retainer means so that the captive key is in a position to unlock and lock the container 1. This aligning means 5 also generally locates the door 23 so that the door can be moved between closed and open positions. The aligning means 5 also generally locates the container 1 with respect to the retaining means so that the pins 32 and 33 on the door 23 may move into the leg 96 of the retainer means L-shaped slot 98.

The described construction does not involve any critical positioning within close limits of the container 1 with respect to the retainer means in coupling the container with the retainer means. That is to say, there is nothing critical in the coupling operation required to enable the depletion signal operation to take place. No close adjustment of the position of the plunger foot 78 is required in order that the plunger 77 when released will in all events actuate the switch 81. The aligning means 5 has been described as assisting in locating the pins 32 and 33 for being received in the retainer slot legs 96. Conversely, the pins 32 and 33 which are received in the legs 96 of the retainer slots aid in obtaining the aligned coupling of the container with the retainer means.

In describing the operation of the money depletion signaling means, it has bedn indicated that such a signal is given by tripping the plunger 77 when the number of bills in the paper money supply 71 has been depleted to a predetermined number of bills. This predetermined number must be equal to or greater than the maximum number of bills that the remote unit is intended or programmed to dispense during any one banking transaction.

The coarse ratcheting of the retainer hook 68 along the series of ratchet openings 70 is intended to permit the compressor 45 to exert the required amount of pressure on the supply of paper money 71 at all times; and also to prevent the compressor 45 from being dislodged during transportation and handling due to the weight of the paper money supply 71 of the container 1 is suspended so that the door 23 is at the top of the container during handling. Normally, the container will be handled by grasping a usual handle 99.

At a time when a container is retained and unlocked in place by retainer means, paper money to be dispensed for a cash dispensing operation at a remote unit may be picked from the container 1 through the money access opening 13 in the door end wall 12 of the container when the door 23 is in open position, as shown for example in FIGS. 2 and 5.

Mechanism in picker mechanism 4 may deliver paper money bills through the opening 100 in picker mechanism housing 4 (FIG. 2) to conveyor rolls 101 (FIG. 1) which form part of a transportation system (not shown) that delivers the paper money to the customer carrying out a banking transaction, in accordance with prior art procedures as in said U.S. Pat. Nos. 3,760,158 and 3,880,320.

OPERATING PROCEDURE

The new system of delivering and supplying paper money to and for automatic banking units under conditions of maximum security, and the new sealed tamper-indicating money dispensing containers used in such system, all in accordance with conceptual aspects of the invention, are further characterized by operating procedures for the new system and for the use of the new container construction in such system, which procedures preferably involve steps described below.

Assume that a container 1 having insufficient paper money therein to satisfy a request for an intended cash dispensing operation, has been removed from its retainer means in a protected compartment of a remote automatic banking unit. A loaded container 1 is positioned in the protected compartment and coupled with its retainer means by engagement of the aligning means 5 and entry of the pins 32 and 33 into the retainer slot legs 96.

The captive key 86 is pressed inward and engaged with the container lock 34 and then rotated to unlocked position, the key 86 thus being held captive in the lock 34. The door 23, thus unlocked, is moved on its tongue and groove slide mounting by manipulation of pins 32 and 33 to open position of FIGS. 2 and 5.

The protected compartment of the remote unit then may be closed and locked and the paper money contents of container 1 may be removed from time to time by picker mechanism 4 to satisfy requested automatic money dispensing banking operations. The container 1 cannot be removed from its retainer means unless the container door 23 is closed and locked.

When the supply of money in the retained container has been depleted to the predetermined amount described, the container 1 is removed from the remote unit by accountable delivery service personnel for replacing the same with a loaded container 1, by closing the container door 23, rotating the captive key 86 to locked position. At this time, the key 86 pops out of the lock 34, and the aligning fastener means 5 may be released, and the container 1 removed or uncoupled from its retainer means. As removed the container 1 is in locked condition and then is transported to a main or central bank.

At the bank, the second non-duplicable key held at the bank is used to unlock the lock 34 followed by opening the door 23, and removal of the lid 14. The container then may be loaded in the manner described. The container 1 must be closed and locked at the bank before being transported to its assigned remote unit which has a captive key 86 matching the key held at the bank.

During transportation, the container 1 is in the possession of an accountable person, that is, one of the typical personnel traditionally performing delivery services with armored cars of banking media. During transportation, the container 1 cannot be opened without physical damage which leaves an indication of entry.

Any discrepancies in the container's contents coinciding with an indication of entry reflects on the accountable personnel. Transferring containers from one accountable party to another is possible by mutual observance of no indication of entry.

Accordingly, the new system of delivering and supplying paper money to and for automatic banking units under conditions of maximum security, and the new container construction forming a part of such system, provide for servicing remote automatic banking system units with large amounts of paper money infrequently and with minimum danger of hold-ups, or robbery of paper money during the delivery of supplies of such money to remote units; provide a system which eliminates charging of remote automatic banking system units with loose currency at frequent or scheduled intervals in small amounts so as to minimize the dangers of hold-ups during such loose currency charging operations; provide a container construction in which large amounts of money may be transported under guarded condition with the container locked at all times, except when located at banking facilities where the container is charged with money and bookkeeping entries are made regarding the disposition of money contained therein when charged or depleted, or when located in retained position at a remote banking unit for which the container holds the unit money supply, so that the locked or sealed container if damaged in any manner visibly indicates tampering of or attempts to tamper with the container to gain unauthorized access to its paper money content; and provide for achieving the objectives stated, and eliminating difficulties heretofore encountered in the art, thus solving problems and obtaining the new results described.

In the foregoing description, certain terms have been used for brevity, clearness and understanding; but no unnecessary limitations are to be implied beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the new system and tamper-indicating containers are used, the construction of the new containers, and the advantageous, new and useful results obtained; the new and useful structures, devices, components, elements, arrangements, systems, procedures, combinations, equipment, operations and relationships are set forth in the appended claims.

We claim:

1. Banking equipment money dispensers of a type in which money dispensing picker mechanism removes paper money bills, one at a time, from a supply stack of such bills at a dispenser station, including:

(a) tamper-indicating paper money supply container means;

(b) retainer means at such dispenser station for the container means;

(c) the container means having walls forming a receiving compartment for a supply stack of paper money bills, said container walls being formed with access opening means throgh which such supply stack is loaded into the compartment at a loading station remote from said dispenser station, and which access opening means is adapted to communicate with money dispenser picker mechanism when the container means is retained at the dispenser station by said retainer means;

(d) closure means for the access opening means;

(e) the closure means including door means mounted on the container means for movement between closed and open positions;

(f) container sealing means including a lock member mounted on the container means, and means interengageable between the lock member, the closure means, and the container means holding the container closure means in sealed condition and the door means in closed condition when the lock member is locked;

(g) key means for the lock member including a first key located securely at the loading station, and a second similar key held captive by said retainer means at said dispenser station;

(h) the first key being operative at the loading station to unlock the lock member thereby permitting opening of the closure means for loading a stack of paper money bills in said compartment through said access opening means and thereafter said first key being operative upon replacing the closure means to lock the lock member and to establish a container sealed condition of said container sealing means;

(i) coupling means including releasable interengageable means on the container and retainer means for coupling the container means in sealed condition with the retainer means; and (j) the second key being operative to unlock the lock member and to hold the sealed container means coupled with the retainer means and simultaneously to release the door means for movement to open position to permit removal through said access opening means of paper money one bill at a time from said supply stack in the compartment by such picker mechanism.

2. The construction defined in claim 1 in which the container means includes a five-sided box member having a base wall, two side walls, a rear end wall, and a door end wall forming access opening means entry means for said receiving compartment; in which the closure means includes lid means for the entry means; in which the door end wall is formed with an access portion of said access opening means; in which the door means is slidably mounted on the door end wall; and in which the interengageable means between the closure means and container means holds the lid means sealed to the box member.

3. The construction defined in claim 2 in which the slidable mounting between the door means and the door end wall includes a sliding tongue and groove mount engageable between the door means, and the box member and lid means.

4. The construction defined in claim 3 in which the sliding tongue and groove mount includes groove means formed on spaced door means slide flanges, slidably engaging outturned flanges on the lid means and box member base wall.

5. The construction defined in claim 2 in which the interengageable means between the closure means and container means includes bayonet joint pins on the lid means releasably engaged with L-shaped slots formed adjacent the top edges of the box member side walls.

6. The construction defined in claim 4 in which the lock member mounted on the container means has a lock bolt engaging a stop block mounted on one of the door slide flanges holding the door means in closed condition when the lock member is locked.

7. The construction defined in claim 1 in which the retainer means and container means are formed with aligning means which locate the container means during coupling with the retainer means at a position in which the sealed container means may be held coupled to the retainer means.

8. The construction defined in claim 7 in which the aligning means includes L-shaped slot means formed in the retainer means, and pin means carried by the door means engageable in first legs of said L-shaped slot means, to locate the container means at said position to be held coupled to the retainer means.

9. The construction defined in claim 8 in which the retainer means is provided with a captive key retainer housing; in which the second key is movably held captive in said captive key retainer housing; in which the second key is aligned with the lock member when the container means is located by the aligning means during coupling at a position to be held coupled to the retainer means.

10. The construction defined in claim 9 in which the second key held captive in the key retainer housing is biased away from the lock member; and in which engagement of the second key with the lock member and operation of the second key thereafter to unlock the lock member engages a lug on the second key with the lock member to hold the sealed container means coupled to the retainer means.

11. The construction defined in claim 10 in which the pin means on the door means moves into and engages in the second legs of the L-shaped slot means when the door means is moved to open position upon release of the door means by unlocking the lock member with the second key; and in which engagement of the pin means in the L-shaped slot means second legs holds the sealed container coupled to the retainer means.

12. The construction defined in claim 8 in which the aligning means also includes interengageable pin and bracket fastener means on the container means and retainer means.

13. The construction defined in claim 8 in which the door means pin means projects from the retainer means L-shaped slot means to provide handles for moving the door means between closed and open positions while the container means is coupled to the retainer means.

14. The construction defined in claim 10 in which the second key is biased to retracted position away from the lock member by spring means held in said key retainer housing; in which the second key has a barrel telescoped into a barrel opening in the lock member when moving the second key from retracted position to a position to unlock the lock member; and in which when the second key barrel is telescoped in the lock member barrel opening, the second key then is rotated to unlock the lock member and to engage the key lug with the lock member to hold the second key engaged with the lock member while the lock member is in unlocked condition.

15. The construction defined in claim 1 in which the retainer means is formed as a part of picker mechanism for picking bills one at a time from the supply stack in a coupled container means through the access opening when the door means is in open position; and in which said picker mechanism delivers the bills picked from the supply stack one at a time to bill conveyor means.

16. The construction defined in claim 1 in which paper money bill compressor means is slidably mounted in the compartment for engagement with a supply stack of paper money bills in the compartment; and in which the compressor means is biased toward the supply stack to maintain the supply stack compressed.

17. The construction defined in claim 16 in which spaced rail means are located in the compartment, in which guide rod means is mounted in the compartment between rails of the spaced rail means, and in which slide and guide means mount the compressor means slidably on said guide rod means and rail means.

18. The construction defined in claim 16 in which the compressor means is provided with latch means pivotally mounted on the compressor means; and in which the container means has retainer hook means releasably engaged by said latch means to hold the compressor means at non-compressing position in the compartment to enable paper money bills to be loaded in the compartment.

19. The construction defined in claim 16 in which the compressor means is provided with latch means pivotally mounted thereon; in which the latch means and rail means form interengageable ratchet means preventing movement of the compressor to disengage the supply stack.

20. The construction defined in claim 19 in which the ratchet means includes a notch formed in the compressor latch meand engageable selectively in one of a series of ratchet openings formed at intervals in the rail means to prevent compressor means movement away from any engaged ratchet opening to disengage the supply stack; whereby the compressor means is prevented from releasing compressive engagement of the supply stack regardless of the number of paper money bills in the supply stack or the orientation of the container means during transportation between a loading station and a dispenser station.

21. The construction defined in claim 1 in which depletion indicator signal switch means is mounted on the retainer means; in which plunger means is movably mounted on the container means movable between latched and extended positions; in which the plunger means is biased toward extended position; in which releasable latch lever means is pivotally mounted in the container normally holding said plunger means in latched position; in which said latch lever means is biased toward latched position; in which trigger means is movably mounted on the container means; and in which said trigger means engages and releases said latch lever means from latching said plunger means when the supply of paper money in said container means is depleted to a predetermined degree; whereby when released said plunger means moves to extended position and engages said switch means to signal depletion of paper money in the container means.

22. The construction defined in claim 21 in which the compressor means for the supply stack is movably mounted in the compartment biased to press the supply stack toward the door means, and in which the trigger means is adjustably mounted on the compressor means.

23. The construction defined in claim 22 in which the plunger means and latch lever means have interengageable hook means normally engaged to hold the plunger means in latched position.

24. The construction defined in claim 23 in which the door means has a reset flange; in which the plunger means and latch lever means are formed with interengageable cam surfaces which resets the plunger means in latched position when the door means reset flange engages the plunger means during movement of the door means to closed position on the container means.

25. Banking equipment money dispensers of a type in which money dispenser picker mechanism removes paper money bills, one at a time, from a supply stack of such bills at a dispenser station, including:

(a) paper money container means forming a compartment;

(b) a supply stack of paper money in said compartment;

(c) the container means being formed with access opening meas through which paper money bills may be removed one at a time from said supply stack;

(d) door means mounted on the container means movable to cover or uncover said access opening means;

(e) lock-key means for the door means including a lock member mounted on the container means for locking the door means in access opening means covered position, a first key located securely at a loading station for unlocking the lock member at the loading station to permit the door means to be moved to uncover the access opening means thereby rendering said compartment accessible for entry of a stack of paper money into said compartment at the loading station, said first key actuating the lock member to lock the door means in covered position after loading said compartment with said stack of paper money;

(f) retainer means for the container means located at a dispenser station remote from said loading station, to which retainer means the container means may be coupled when the container means door means is locked in covered position;

(g) the lock-key means including a second key similar to said first key held captive by said retainer means in position to actuate the lock member when the container means is coupled with the retainer means in position to be held coupled;

(h) said captive key being engageable with a coupled container means lock member to unlock said lock member;

(i) said captive key being movable to a position unlocking the lock member and being held to said lock member when the lock member is unlocked; and (j) the door means being movable to a position uncovering said access opening means when the lock member is unlocked while the container means is retained coupled to said retainer means;

(k) whereby paper money bills may be removed by such picker mechanism one at a time through said uncovered access opening means from the supply of paper money in the compartment.

26. Banking equipment money dispensers of a type in which money dispenser picker mechanism removes paper money bills, one at a time, from a supply stack of such bills at a dispenser station, including:

(a) paper money container means forming a compartment;

(b) a supply stack of paper money in said compartment;

(c) the container means having a wall formed with an access opening through which paper money bills may be removed one at a time from said supply stack;

(d) door means for said access opening mounted on the container means for movement between open and closed positions;

(e) lock means for the door means including a lock member mounted on the container means for locking the door means in closed position, and first means for actuating the lock means at a loading station for unlocking the lock member at the loading station to permit opening of the door means thereby rendering said compartment accessible for entry of a stack of paper money into said compartment at the loading station, said first actuating means being operative to lock the door means in closed position after loading said compartment wth said stack of paper money;

(f) retainer means for the container means located at a dispenser station remote from said loading station, to which retainer means the container means may be coupled when the container means door means is locked in closed position;

(g) second actuating means for the lock means operable at the dispenser station to unlock the lock member when the container means is held coupled with the retainer means;

(h) said second actuating means being operable to lock the lock member to permit the container means to be uncoupled from the retainer means;

(i) the door means being movable to open position to uncover said access opening when the lock member is unlocked while the container means is retained coupled to said retainer means; and (j) the door means preventing the second actuating means from locking the locking member until the door means is moved to closed position while the container means is coupled to the retainer means;

(k) whereby paper money bills may be removed by such picker mechanism one at a time through said access opening from the supply of paper money in the compartment.

27. Banking equipment money dispensers of a type in which money dispensing picker mechanism removes paper money bills, one at a time, from a supply stack of such bills at a dispenser station, including:

(a) paper money supply container means;

(b) retainer means at such dispenser station for the container means;

(c) the container means having walls forming a receiving compartment for a supply stack of paper money bills, said container walls being formed with paper money loading and dispensing opening means through which such supply stack is loaded into the compartment at a loading station remote from said dispenser station, and which loading and dispensing opening means provides access for communication with money dispenser picker mechanism when the container means is retained at the dispenser station by said retainer means;

(d) closure means for the loading and dispensing opening means;

(e) the closure means including door means mounted on the container means for movement between closed and open positions;

(f) container sealing means including a lock member mounted on the container means, and means interengageable between the lock member, the closure means, and the container means holding the container closure means in sealed condition and the door means in closed condition when the lock member is locked;

(g) means for actuating the lock member between locked and unlocked conditions including means operable at each of the loading and dispenser stations;

(h) the means for actuating the lock member at the loading station being operative to unlock the lock member thereby permitting the closure means to be opened for loading a stack of paper money bills in said compartment, and thereafter being operative upon closing the closure means to lock the lock member and to establish a container sealed condition of said container sealing means;

(i) coupling means including releasable interengageable means on the container and retainer means for coupling the container means in sealed condition with the retainer means; and (j) the means for actuating the lock member at the dispenser station being operative to unlock the lock member of a sealed container means coupled with the retainer means, and being operative simultaneously to release the door means for movement to open position to permit removal through said loading and dispensing opening means of paper money one bill at a time from said supply stack in the compartment by such picker mechanism.

28. A method for delivering, under conditions of maximum security a stack of paper money bills in a sealed container having a dispenser opening, from a container loading station to a banking equipment money dispenser picker which picks bills one at a time from said sealed container through said dispenser opening when uncovered at a remote money dispenser station, the steps of:

(a) loading at said loading station a stack of paper money bills in a stack-receiving compartment of such container;

(b) then at said loading station closing said container, covering the dispenser opening, and locking a lock member mounted on the container, to maintain said closed container and its covered dispenser opening in sealed condition;

(c) delivering the locked sealed money-loaded container in sealed condition from the loading station to a remote dispenser station;

(d) placing said delivered sealed container in position to be coupled to dispenser station retainer means;

(e) and then unlocking the lock member, uncovering the dispenser opening, and holding said container coupled to said retainer means throughout the time when said dispenser opening is uncovered and the lock member is unlocked, to enable dispenser picker access to the supply of paper money in said sealed container; and (f) whereby the supply of said money in the container is sealed at all times in the container compartment except during loading at the loading station and when the dispenser opening is uncovered while the container is held coupled to the dispenser station retainer means.

29. A method for delivering, under conditions of maximum security a stack of paper money bills in a tamper-indicating sealed container having a dispenser opening, from a container loading station to a banking equipment money dispenser picker which picks bills one at a time from said sealed container through said dispenser opening when uncovered at a remote money dispenser station, the steps of:

(a) loading at said loading station a stack of paper money bills in a stack-receiving compartment of such container;

(b) then at said loading station closing said container, covering the dispenser opening, and locking a lock member mounted on the container, to maintain said closed container and its covered dispenser opening in sealed condition with a first key maintained secure at said loading station;

(c) delivering the locked sealed money-loaded container in sealed condition from the loading station to a remote dispenser station;

(d) maintaining a second key, which is a mate to said first key, mounted captive at said dispenser station;

(e) placing said delivered sealed container in position to be coupled to dispenser station retainer means;

(f) with said second key unlocking the lock member;

(g) uncovering the dispenser opening; and (h) holding said container coupled to said retainer means throughout the time when said dispenser opening is uncovered and the locking member is unlocked, to enable dispenser picker access to the supply of paper money in said sealed container;

(i) whereby the supply of said money in the container is sealed at all times in the container compartment except during loading at the loading station and when the dispenser opening is uncovered while the container is held coupled to the dispenser station retainer means.

30. In the method defined in claim 29, the further steps of:

(a) providing at least two containers for each dispenser station;

(b) providing identical lock members on each such container;

(c) loading, locking and delivering each such container in the same manner for said dispenser station;

(d) retaining a first such container coupled at said dispenser station until the supply of paper money in said first container is depleted to a predetermined degree;

(e) then removing such first container whose money supply has been depleted from said dispenser station;

(f) then replacing the removed first container with another such container; and (g) then returning said first container to the loading station for reloading.

* * * * *

UNITED STATES PATENT AND TRADEMARK OFFICE

CERTIFICATE OF CORRECTION

PATENT NO. : 4,113,140

DATED : September 12, 1978

INVENTOR(S) : Harry T. Graef, et al.

It is certified that error appears in the above-identified patent and that said Letters Patent are hereby corrected as shown below:

Column 13, Line 52 - change "bedn" to -been-

Column 16, Line 8 - change "throgh" to -through-

Column 18, Line 41 - change "meand" to -means-

Column 19, Line 26 - change "meas" to -means-

Column 20, Line 28 - change "wth" to -with-

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*